US009332867B2

(12) United States Patent
Chase et al.

(10) Patent No.: US 9,332,867 B2
(45) Date of Patent: May 10, 2016

(54) FOOD SERVING AND STORAGE ASSEMBLY

(71) Applicant: TARGET BRANDS, INC., Minneapolis, MN (US)

(72) Inventors: Mark Chase, Minneapolis, MN (US); Samuel D. Silva, Robbinsdale, MN (US)

(73) Assignee: Target Brands, Inc., Minneapolis, MN (US)

( * ) Notice: Subject to any disclaimer, the term of this patent is extended or adjusted under 35 U.S.C. 154(b) by 201 days.

(21) Appl. No.: 14/279,668

(22) Filed: May 16, 2014

(65) Prior Publication Data

US 2015/0327700 A1 Nov. 19, 2015

(51) Int. Cl.

| | |
|---|---|
| ***A47G 19/06*** | (2006.01) |
| ***B65D 43/02*** | (2006.01) |
| ***B65D 51/24*** | (2006.01) |
| ***B65D 45/16*** | (2006.01) |
| ***A47G 21/02*** | (2006.01) |
| ***A47G 21/04*** | (2006.01) |
| ***B65B 7/28*** | (2006.01) |
| ***B65B 61/14*** | (2006.01) |

(52) U.S. Cl.

CPC ..... *A47G 19/06* (2013.01); *A47G 21/02* (2013.01); *A47G 21/04* (2013.01); *B65B 7/2842* (2013.01); *B65B 61/14* (2013.01); *B65D 43/02* (2013.01); *B65D 45/16* (2013.01); *B65D 51/246* (2013.01)

(58) Field of Classification Search

CPC ..... A47G 19/06; A47G 21/04; A47G 21/02; A47G 19/30; B65D 45/16; B65B 61/14; B65B 7/2842; A47J 47/02

USPC ..... 220/735, 756

See application file for complete search history.

(56) References Cited

U.S. PATENT DOCUMENTS

| | | | |
|---|---|---|---|
| 1,853,852 | A | 4/1932 | Estes |
| 3,194,460 | A | 7/1965 | Tupper |
| D241,600 | S | 9/1976 | Ashton |
| 4,170,302 | A | 10/1979 | Baca |
| 5,829,342 | A | 11/1998 | Lee |
| 5,924,592 | A | 7/1999 | Hieronymus |
| D493,665 | S | 8/2004 | Warning |
| D547,124 | S | 7/2007 | Peretz |
| D577,960 | S | 10/2008 | Ersan |
| 7,485,831 | B2 | 2/2009 | Tynes et al. |
| D599,617 | S | 9/2009 | Ye |
| D630,887 | S | 1/2011 | Olivari |

(Continued)

OTHER PUBLICATIONS

Office Action from Canadian Patent Application No. 2,851,730, mailed Oct. 15, 2014 (3 pages).

(Continued)

*Primary Examiner* — Stephen Castellano

(74) *Attorney, Agent, or Firm* — Griffiths & Seaton PLLC; JoAnn M. Seaton

(57) ABSTRACT

A food storage and serving assembly includes a bowl, a cover, and a utensil. The bowl defines a cavity therein and includes a latch saddle radially extending outwardly from a remainder of the bowl. The cover extends over the bowl to enclose the cavity. The cover includes a latch hook selectively secured within the latch saddle to maintain the cover over the bowl. The utensil is selectively coupled with the bowl and extends about the latch hook and the latch saddle. The utensil defines a handle portion extending above the bowl and the cover to facilitate user transport of the food storage and serving assembly at least partially via the handle portion of the utensil.

16 Claims, 12 Drawing Sheets

(56) References Cited

U.S. PATENT DOCUMENTS

| | | | |
|---|---|---|---|
| 7,947,928 | B2 | 5/2011 | Tynes et al. |
| 2011/0310693 | A1 | 12/2011 | Maurer |
| 2012/0097571 | A1 | 4/2012 | Lerner |
| 2012/0132652 | A1 | 5/2012 | Barber |

OTHER PUBLICATIONS

"Chill Salad Bowl with Servers," printed from http://reviews.crateandbarrel.com/7258/40383/chill-salad-bowl-with-servers-reviews/reviews.htm, publicly available at least as early as Mar. 29, 2011 (3 pages).

"Sparrow Salad Bowl with Green Serving Spoons," printed from www.amazon.co.uk/Sparrow-Salad-Green-Serving-Spoons/dp/B004ODEPSC, publicly available at least as early as Jul. 11, 2011 (4 pages).

"Kosiol Leaf Medium Salad Bowl with Integrated Servers," printed from www.koziol-shop.co.uk/koziol-kitchen-dining-c32/utensils-serving-c42/koziol-leaf-medium-salad-bowl-with-integrated-servers-p7142, publicly available at least as early as Jul. 12, 2012, per http://web.archive.org (2 pages).

"Joseph Joseph Hands on Salad Bowl and Servers from John Lewis," printed from http://furnish.co.uk/items/101828-joseph-joseph-hands-on-salad-bowl-and-servers, publicly available at least as early as Mar. 20, 2013 (2 pages).

"Snap bowl set with snap closure cover," printed from www.successories.com/products/Promotional-Products/Home-Fam...ners-Food-Storage/834/41440/Salad-bowl-set-with-snap-closure-cover, publicly available at least as early as Mar. 21, 2013 (2 pages).

FOOD SERVING AND STORAGE ASSEMBLY

CROSS-REFERENCE TO RELATED APPLICATION

This application is related to U.S. Design patent application Ser. No. 29/491,058, filed on an even date herewith.

BACKGROUND OF THE INVENTION

Salads have long been an enjoyable and/or nutritional meal or addition to a meal. To mix the ingredients of a salad, utensils are typically used to toss the ingredients within a bowl. When a salad is made with leafy greens, it often is desirable to wait to mix a salad until just before serving. In addition, it is desirable to occasionally remix salads made with a dressing or other component that is likely to settle to a bottom of the bowl, for example, just before serving and/or during serving so that individuals consuming the salad are able to taste all salad components in a single serving.

Salads are a common meal or side dish taken to picnics, potluck meals, or other locations to be served away from the kitchen of the salad preparer. To optimize easy transport of a salad and utensils for preparing or serving the salad away from a preparer's home, it is desirable to have a bowl, a cover, and serving utensils all maintained as a single assembly. To facilitate use, it is generally desirable that the cover and serving utensils are readily uncouplable from the bowl for preparation and serving of the salad contained within the bowl.

SUMMARY OF THE INVENTION

One aspect of the present invention relates to a food storage and serving assembly including a bowl, a cover, and a utensil. The bowl defines a cavity therein and includes a latch saddle radially extending outwardly from a remainder of the bowl. The cover extends over the bowl to enclose the cavity. The cover includes a latch hook selectively secured within the latch saddle to maintain the cover over the bowl. The utensil is selectively coupled with the bowl and extends about the latch hook and the latch saddle. The utensil defines a handle portion extending above the bowl and the cover to facilitate user transport of the food storage and serving assembly at least partially via the handle portion of the utensil. Other apparatus, assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
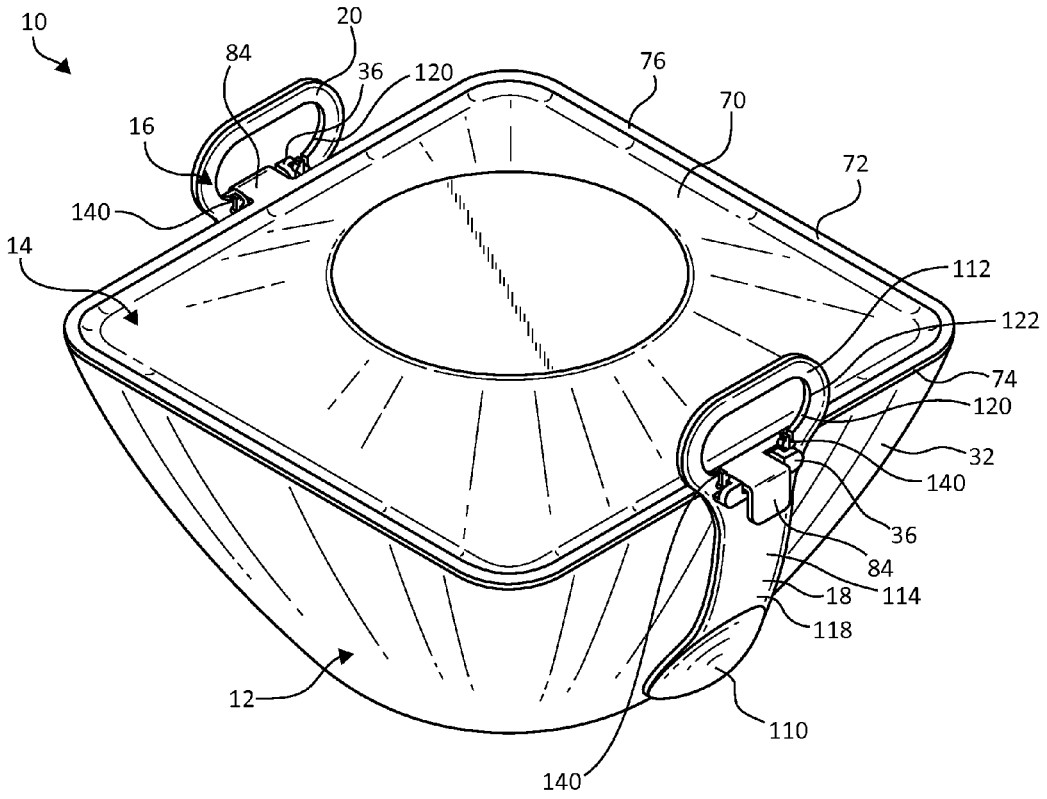
FIG. 1 is a front, perspective view illustration of a food storage and serving assembly, according to one embodiment of the present invention.
Figure 2:
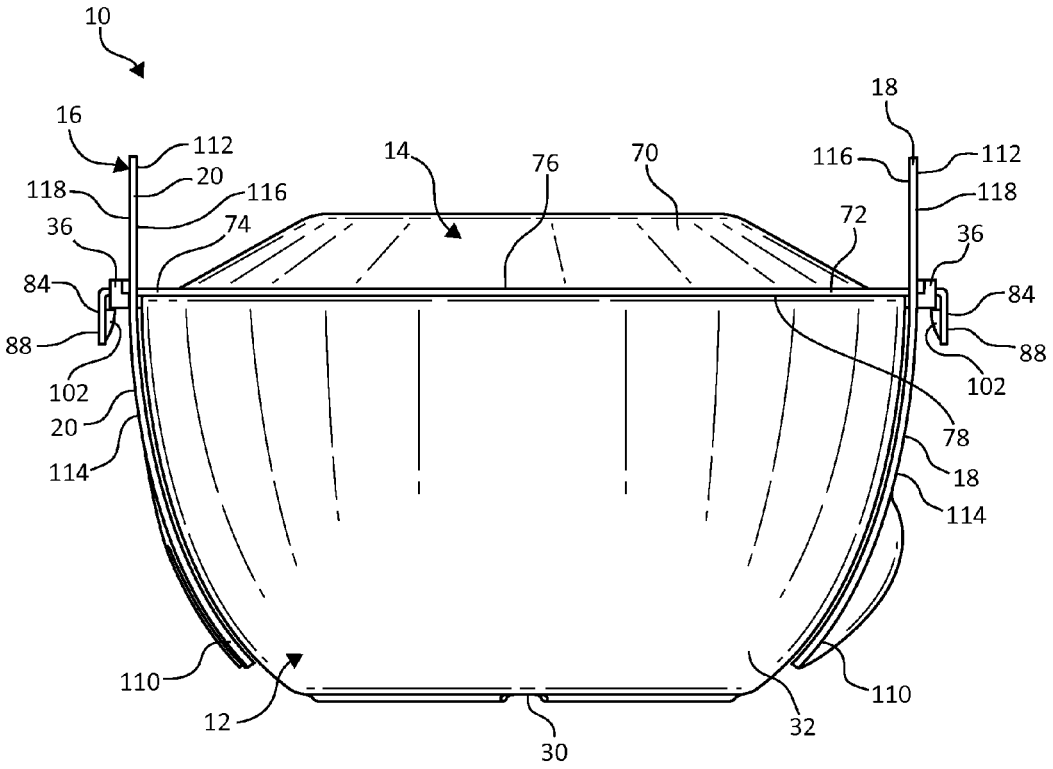
FIG. 2 is a front view illustration of the food storage and serving assembly of FIG. 1, according to one embodiment of the present invention.
Figure 3:
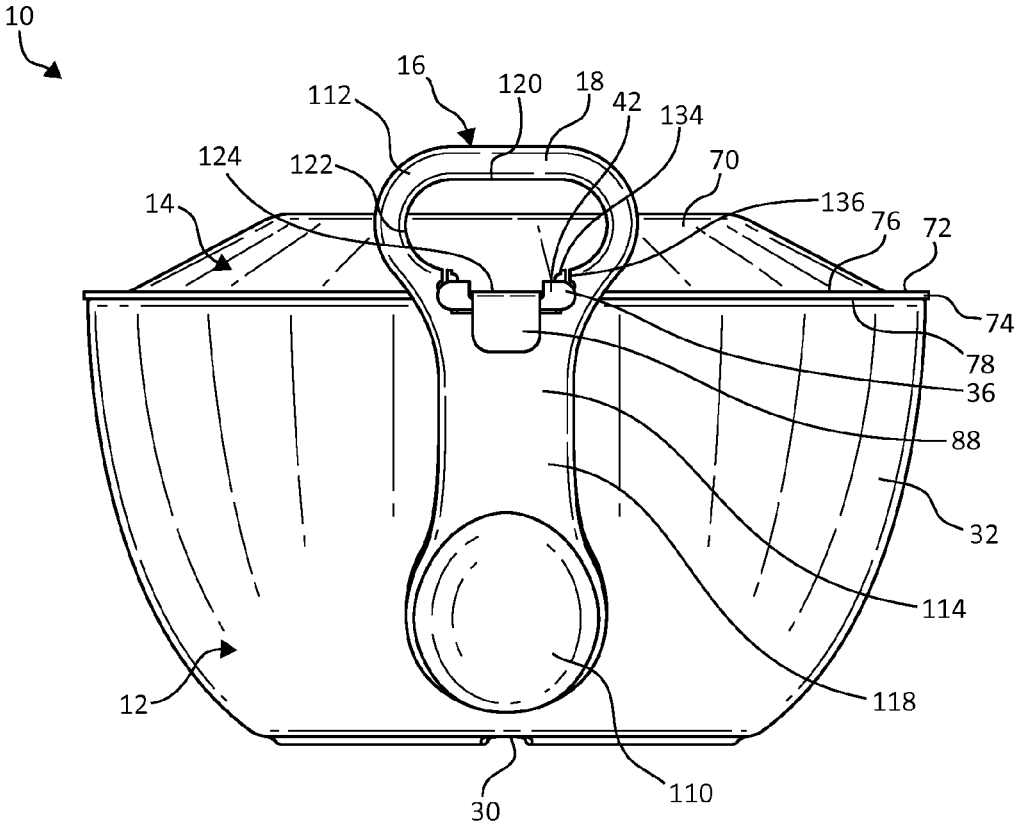
FIG. 3 is a right side view illustration of the food storage and serving assembly of FIG. 1, according to one embodiment of the present invention.
Figure 4:
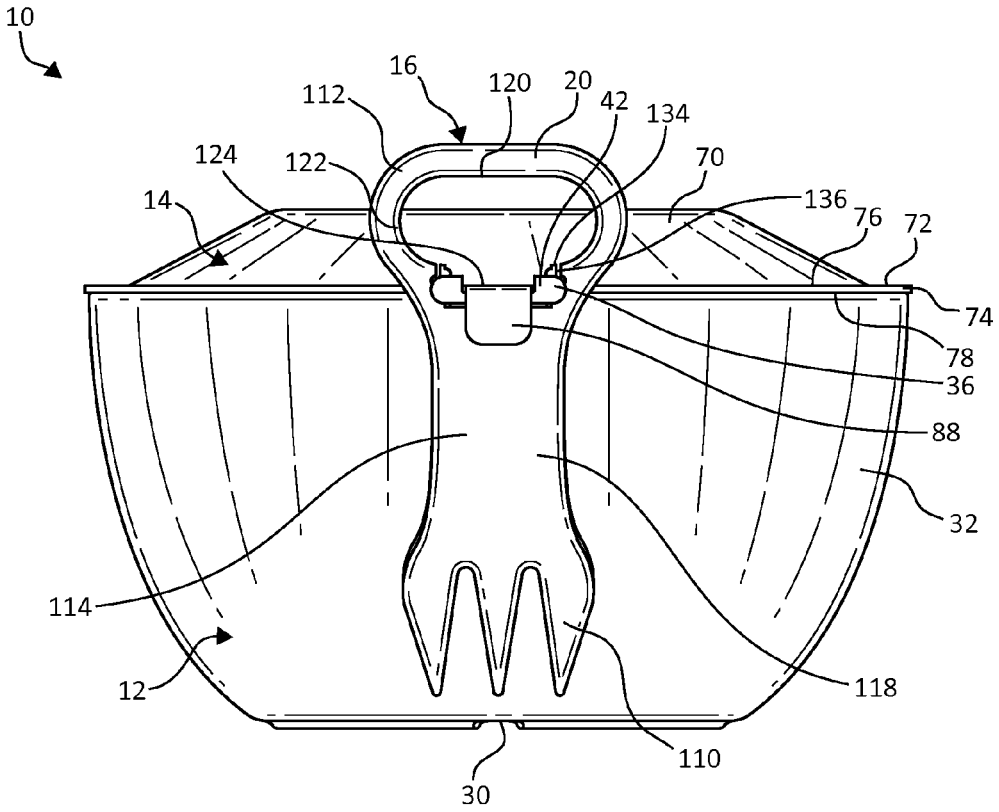
FIG. 4 is a left side view illustration of the food storage and serving assembly of FIG. 1, according to one embodiment of the present invention.
Figure 5:
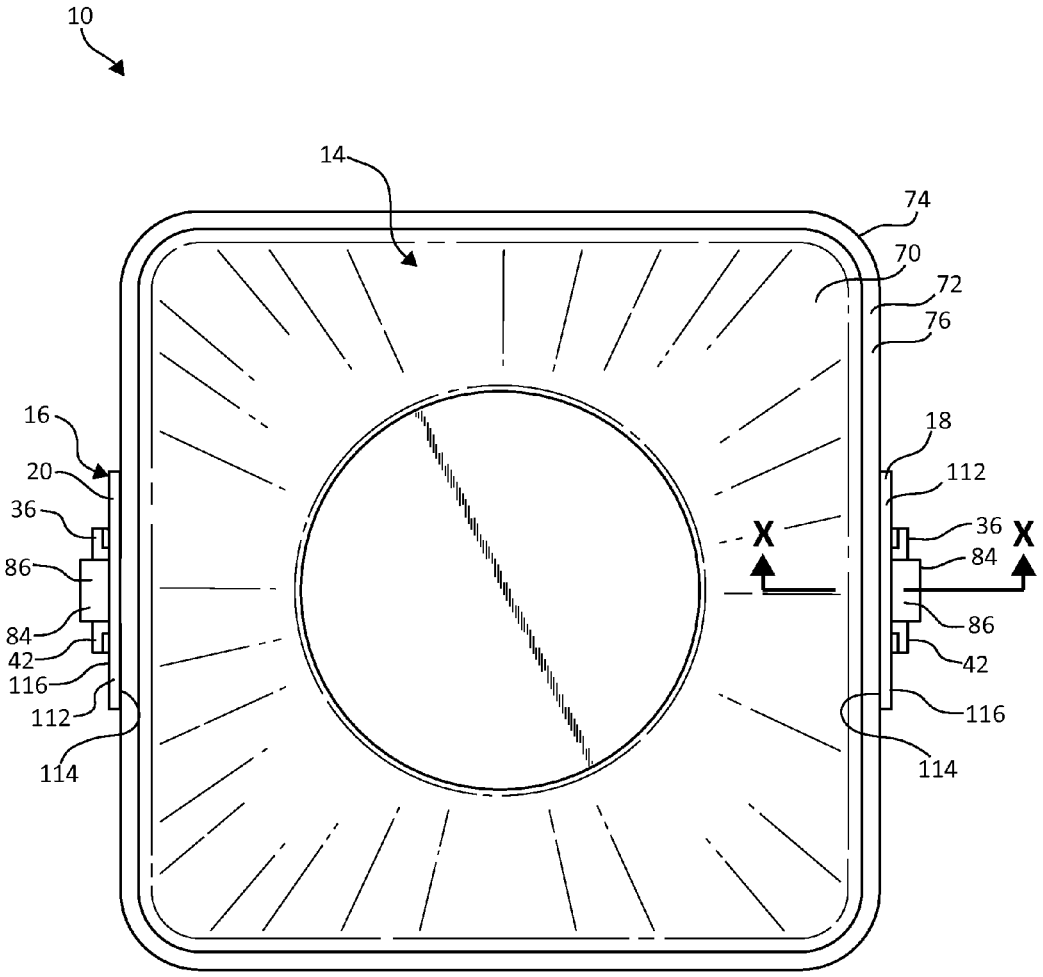
FIG. 5 is a top view illustration of the food storage and serving assembly of FIG. 1, according to one embodiment of the present invention.
Figure 6:
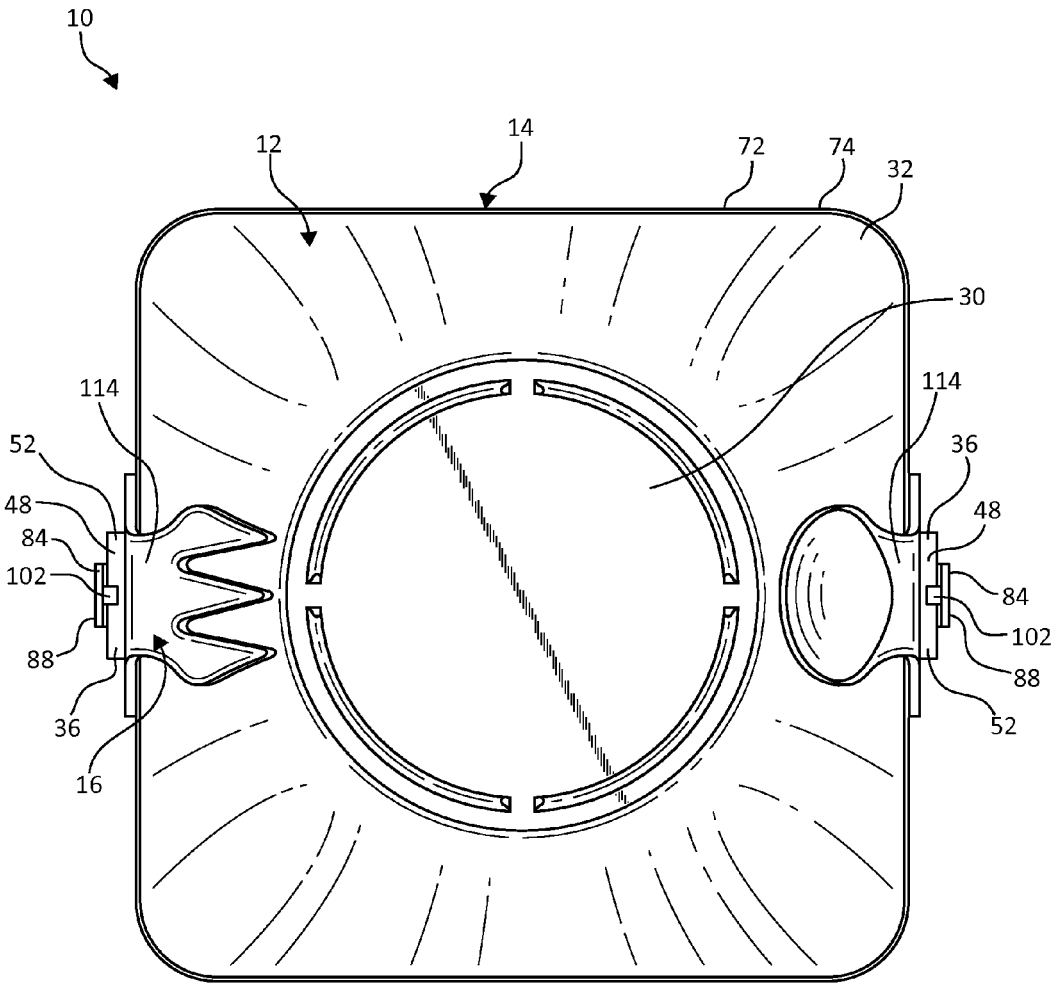
FIG. 6 is a bottom view illustration of the food storage and serving assembly of FIG. 1, according to one embodiment of the present invention.

A food storage and serving assembly of the present invention, for example, as illustrated and/or described herein, provides for storage, transport, and serving of food items, such as salads. The food storage and serving assembly provides a bowl for storing the food item, a cover configured to releasably couple with the bowl, and utensils selectively coupled to the bowl. In one example, the bowl and cover are selectively locked in place relative to one another via two latches, more particularly, one latch on either of two opposing sides of the bowl. The food storage and serving assembly includes two utensils, such as a fork and a spoon, each coupled to the bowl to extend about the latch. In one example, each utensil interfaces with bowl features on opposing sides of the latch such that pulling up on each of the utensils selectively secures each utensil to the bowl. Handle sections of each of the two utensils respectively extend upwardly from the latches forming a gripping or handling sections. When fully assembled, the entire food storage and serving assembly can be carried via the handle sections of the two utensils, according to one embodiment of the innovation.

To ready the food storage and serving assembly for serving, the handles are readily released from the bowl without the use of tools, and the cover is removed from the bowl. In one example, the utensils are moved downwardly to disengage with the bowl for removal therefrom. The utensils may then be used to toss or otherwise mix the food contents of the bowl. When serving is completed, the cover and utensils are recoupled with the bowl to ready the assembly for subsequent transport, for example, back to the preparer's home.

Turning to FIGS. 1-7, one embodiment of a food storage and serving assembly 10 includes a bowl 12, a cover 14, and utensils 16, such as a spoon 18 and a fork 20. Bowl 12 is configured to maintain food items or other goods. Cover 14 serves as a lid enclosing items within bowl 12 and is selectively secured to bowl 12, for example, at two opposing locations on bowl 12. Utensils 16 are selectively secured to bowl 12, for example, without the use of additional fasteners or tools. For instance, each one of two utensils 16 is secured about the two opposing locations where cover 14 is secured to bowl 12. Utensils 16 are configured for use in mixing goods within bowl 12 and for use as handles to ease transport of food storage and serving assembly 10 and any food goods maintained therein.

Bowl 12 includes a bottom 30 and sidewall 32. Sidewall 32 extends upwardly from and circumferentially around bottom 30 forming a cavity 33 (FIG. 7) therein. Sidewall 32 may be configured in any one of a number of manners such that cavity 33 takes any desired shape. Sidewall 32 extends upwardly from bottom 30 terminating in a top edge 34 facing away from bottom 30. Bowl 12 is one example of means for selectively maintaining a food item.

Bowl 12 additionally includes latch saddles 36 or other first latch portions. In one instance, bowl 12 includes two latch saddles 36 each extending from an opposite point of the top edge 34, for example, at midpoints of two opposing linear segments of top edge 34. Each latch saddle 36 extends radially outwardly from top edge 36 of bowl 12. In one example, each latch saddle 36 includes a platform 40 and protruding rails 42 or ribs extending upwardly therefrom. Additionally referring to the detailed view of FIG. 8, platform 40, extends radially outwardly from top edge 34 of bowl 12 to an opposite, outermost edge 44, in one embodiment. Platform 40 defines a top surface 46, which is substantially planar in the illustrated embodiment, and an opposite bottom surface 48, which is also substantially planar in one embodiment. In one example, top surface 46 of platform 40 extends substantially coplanarly with top edge 34 of bowl 12. Platform 40 is substantially T-shaped to define a first or radially extending section 50 and a crossing section 52 extending substantially perpendicularly to radially extending section 50, in one example. Radially extending section 50 is defined between opposing side edges 54 thereof each extending from top edge 34 of bowl 12 to crossing section 52. Crossing section 52 extends outwardly beyond each of and wider than opposing side edges 54 to form side edges 56 thereof. Crossing section 52 defines inwardly facing edges 58 on portions thereof extending on either side of side edges 54 and facing top edge 34 of bowl 12. Crossing section 52 extends radially outwardly from inwardly facing edges to outermost edge 44 of platform 40.

Figure 8:
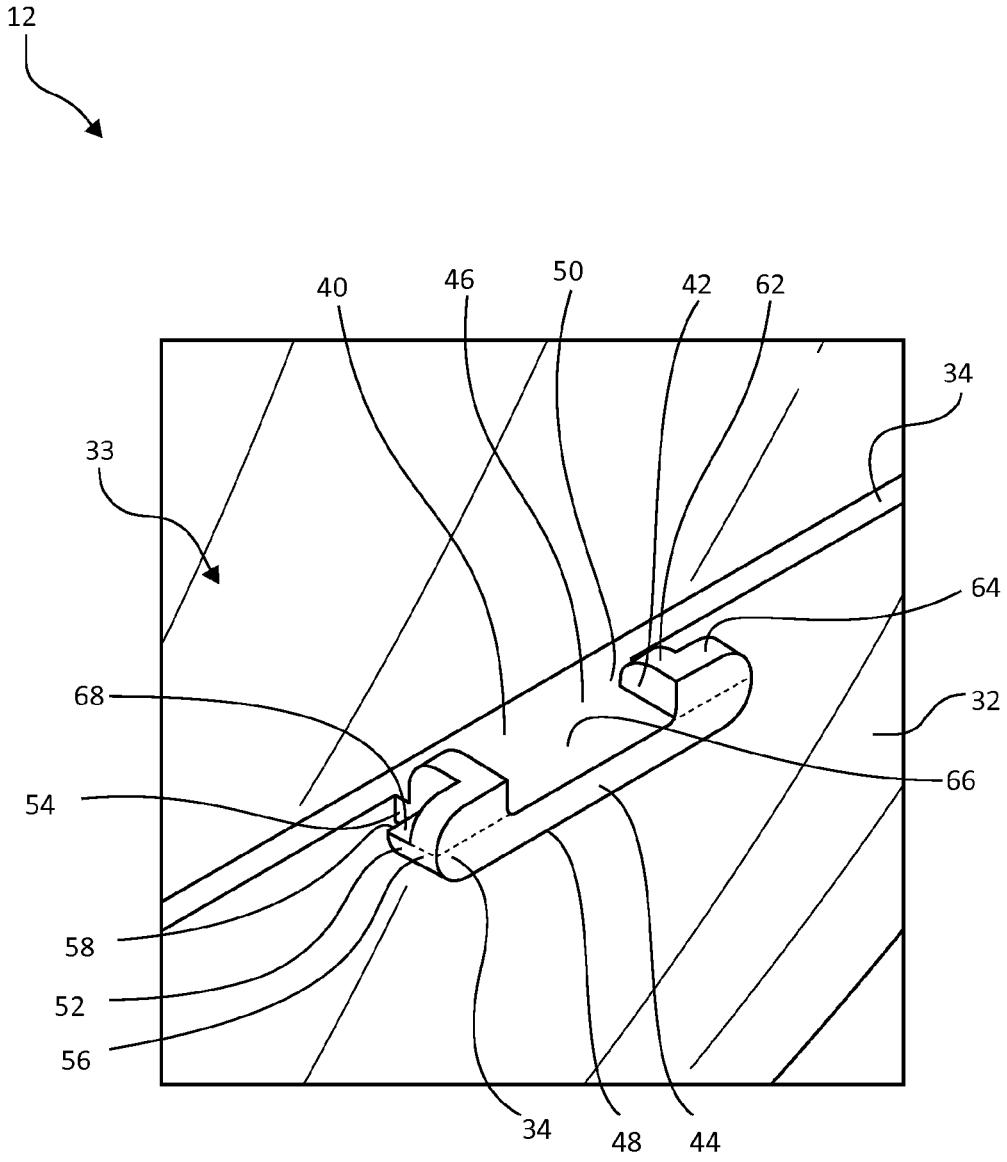
FIG. 8 is an enlarged, partial perspective view illustration of a latch saddle of a bowl of the food storage and serving assembly of FIG. 1, according to one embodiment of the present invention.

Protruding rails 42 extend above top surface 46 of platform 40 where the extension of top surface 46 is illustrated in FIG. 8 with a dashed line for illustrative purposes. In one embodiment, protruding rails 42 extends partially from radially extending section 50 and crossing section 52 in a substantially L-shape. Protruding rails 42, more particularly, may each extend with a first segment 62 and a second segment 64 positioned substantially perpendicularly relative to one another. First segment 62, for example, extends upwardly from a corresponding top surface 46 continuing side edge 54 in a upwardly and substantially coplanarly manner, and second segment 64 extends substantially perpendicularly from an outermost end of first segment 62 along outermost edge 44 to a corresponding side edge 56 of crossing section 52. In one embodiment, second segment 64 extends upwardly and substantially coplanarly with outermost edge 44 of latch saddle 36. In one example, each protruding rail 42 defines a top surface 60 extending across at least first segment 62 of the corresponding protruding rail 42 and extending, in one embodiment, substantially parallel to top surface 46 of platform 40.

As illustrated, latch saddle 36 includes two protruding rails 42 each having an L-shape and being substantially symmetrically placed relative to each other such that second segments 64 of each of protruding rails 42 extends away from the other second segment 64. In this manner, latch saddle 36 defines a channel 66 (FIGS. 7 and 8) or open track above top surface 46 of platform 40 between opposite first segments 62 of protruding rails 42. In one example, each second segment 64 is spaced outwardly from a corresponding interior facing edge 58 such that a portion 68 (FIG. 8) of top surface 46 remains exposed on an interior side of each second segment 64 and transversely external side of a corresponding first segment 62.

In one embodiment, bowl 12 including latch saddles 36 is formed as a single piece, for example, a single homogenous piece of injection molded plastic or other suitable material. In one example, latch saddles 36 are substantially symmetrically positioned relative to one another. Other variations of bowl 12 will be apparent to those of skill in the art after reading this application.

Figure 7:
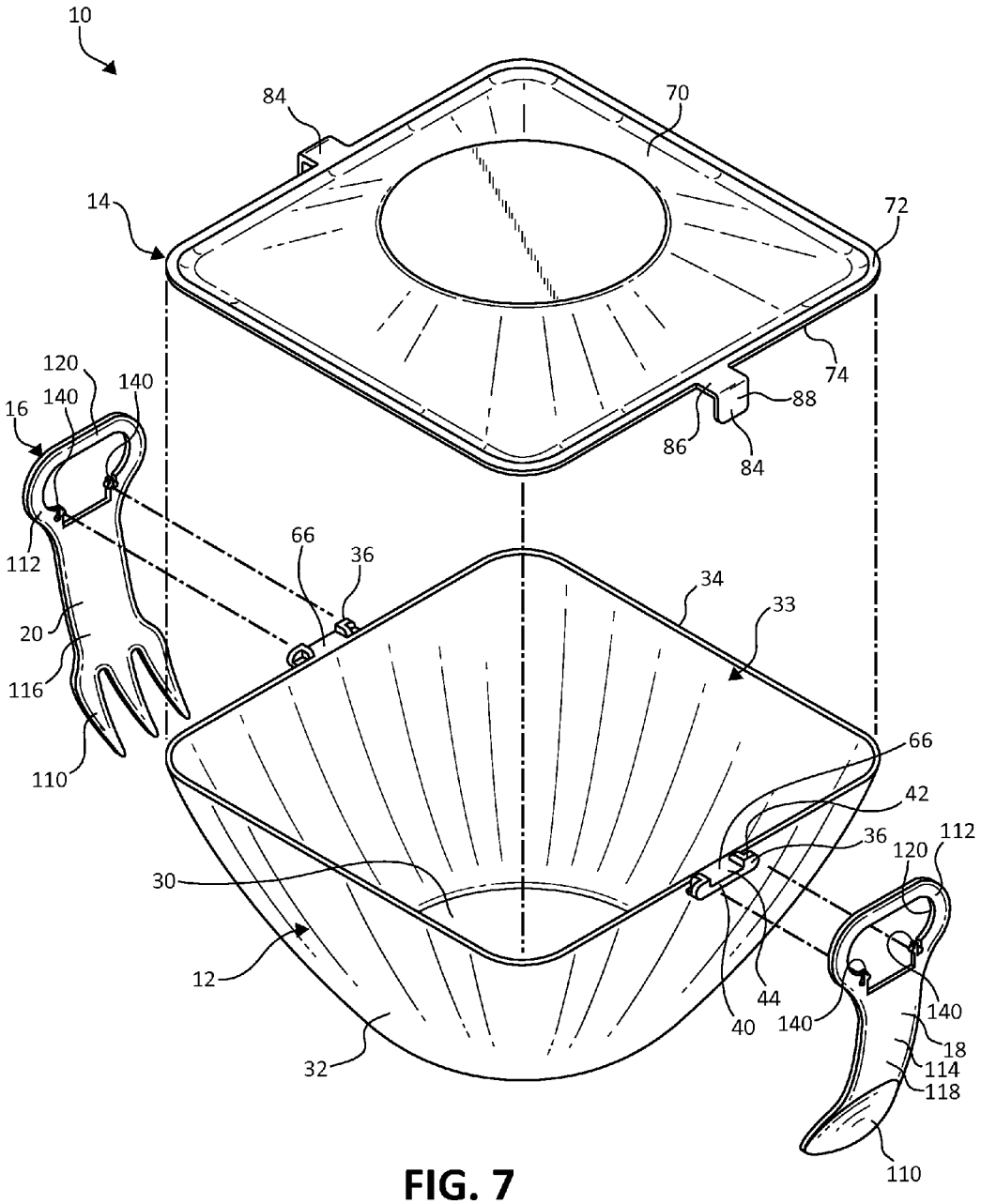
FIG. 7 is a front, exploded perspective view illustration of the food storage and serving assembly of FIG. 1, according to one embodiment of the present invention.

Referring primarily to FIG. 7, in one example, cover 14 includes a top or primary panel 70 and a perimeter flange 72. Primary panel 70 is sized and shaped to substantially cover an opening of bowl 12. Perimeter flange 72 extends radially and substantially circumferentially around primary panel 70 in a substantially planar and, in one example, a substantially horizontal manner to an outside perimeter edge 74. Perimeter flange 72 defines a top surface 76 and a bottom surface 78 opposite top surface 76. Additionally referring to the cross-sectional illustration of FIG. 10, in one example, cover 14 additionally defines an interior rim 80 or protrusion circumferentially extending around an underside of primary panel 70 just inside of and adjacent to perimeter flange 72.

Cover 14 additionally includes latch hooks 84 extending radially outwardly from two opposing points of perimeter flange 72, for example, at midpoints of two opposing linear segments of perimeter flange 72 corresponding with positions of latch saddles 36 of bowl 12. Each latch hook 84 includes a radially extending section 86, which extends outwardly from perimeter edge 74 of perimeter flange 72, and a downwardly depending section 88 extending from an end of radially extending section 86 opposite perimeter flange 72. Additionally, referring to FIGS. 9 and 10, in one example, radially extending section 86 is substantially planar and defines a top surface 90, a bottom surface 92 opposite top surface 90, and opposing side edges 94 extending between each of top surface 90 and bottom surface 92. Top surface 90 of each latch saddle 36 extends substantially coplanarly with top surface 76 of perimeter flange 72 of cover 14 and extends substantially perpendicularly from the immediately adjacent linear segment of perimeter flange 72.

Downwardly depending section 88 extends downwardly from an end of radially extending section 86 opposite perimeter flange 72 to a bottom edge 96 of downwardly depending section 88, in one example. Downwardly depending section 88 is substantially planar and, in one embodiment, extends substantially perpendicularly relative to radially extending section 86 with a substantially identical width as a width of radially extending section 86. In one example, downwardly depending section 88 defines opposing side edges 98, for instance, as continuations of the opposing side edges 94 of radially extending section 86.

Downwardly depending section 88 further defines an interior facing surface 100 and a protruding tab 102 or protrusion extending inwardly from interior facing surface 100. Interior facing surface 100 faces sidewall 32 of bowl 12 and, in one embodiment, is substantially planar. Protruding tab 102 is narrower than downwardly depending section 88 and, in one example, extends inwardly from interior facing surface 100 in a position substantially centered between opposing side edges 98 of downwardly depending section 88 (see, for example, FIG. 6). More specifically, in one embodiment, protruding tab 102 extends from bottom edge 96 or near bottom edge 96 of downwardly depending section 88 toward, but not entirely to, bottom surface 92 of radially extending section 86. In this manner, protruding tab 102 defines a top surface 104 spaced from bottom surface 92 of radially extending section 86 by a distance equal to or greater than a thickness of platform 40 measured between top surface 46 and bottom surface 48 (see, for example, FIG. 10). In one embodiment, cover 14 is formed as a single piece such as a single injection molded or otherwise homogenously formed piece of plastic or other suitable material. The material of cover 14 allows downwardly depending section 88 to flex outwardly during placement on bowl 12, but to return to near it original or biased position to selectively lock cover 14 to bowl 12, as will be further described below.

Cover 14 is coupled to bowl 12 via latch saddles 36 and latch hooks 84, which collectively define a latch of food storage and serving assembly 10. As such, cover 14 defines one example of means for covering bowl 12. In one embodiment, cover 14 is held in place relative to bowl 12 solely via latches, each collectively defined by one of latch saddles 36 and a corresponding one of latch hooks 84, where each latch saddle 36 and latch hook 84 pair defines a latch. While the latch is primarily described and illustrated with bowl 12 including latch saddle 36 and cover 14 including latch hook 84, in one example, the opposite is true, that is, bowl 12 includes latch hook 84 and cover 14 includes latch saddle 36.

Figure 9:
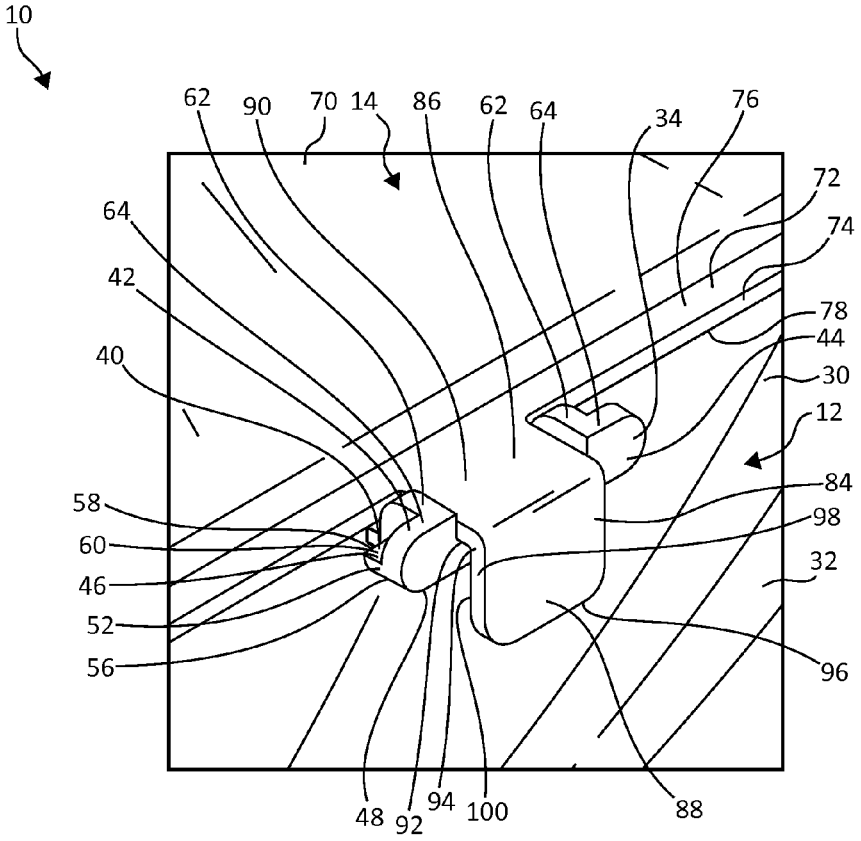
FIG. 9 is an enlarged, partial perspective view illustration of a latch of the food storage and serving assembly of FIG. 1, according to one embodiment of the present invention.
Figure 10:
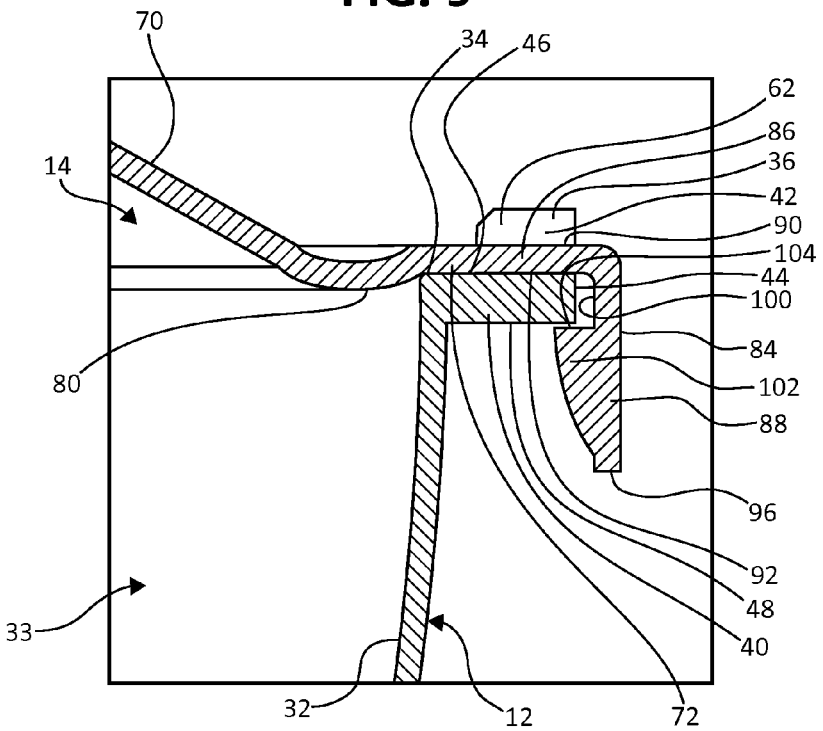
FIG. 10 is a cross-sectional view illustration of the food storage and serving assembly taken about line X-X in FIG. 5, according to one embodiment of the present invention.

Cover 14 is sized to allow for substantially simultaneous coupling of the two latch hooks 84 with their respective one of latch saddles 36. Cover 14 is, more particularly, positioned such that bottom surface 78 of perimeter flange 72 faces and/or contacts top edge 34 of bowl 12 about a substantially entire periphery of top edge 34. In one embodiment, as illustrated in FIGS. 9 and 10, for example, bottom surface 92 of radially extending section 86 of latch hook 84 of cover 14 is placed immediately adjacent top surface 46 of platform 40 within channel 66 (FIG. 8) between the two protruding rails 42. Side edges 94 of radially extending section 86 contact or fit just within each of first linear segments 62 of protruding rails 42 as a width of channel 66 is substantially identical to a width of radially extending section 86, in one example. Radially extending section 86 is one example of radially extending means for coupling with bowl 12.

Cover 14 is pushed toward bowl 12 and latch hooks 84 are pushed into engagement with latch saddles 36 to selectively secure cover 14 to bowl 12. As latch hooks 84 are pushed toward latch saddles 36, in one embodiment, downwardly depending section 88 of each latch hook 84 flexes radially outwardly allowing protruding tab 102 to pass outside edge 44 of platform 40. Once protruding tab 102 has passed outside edge 44, downwardly depending section 88 returns to it originally biased position to selectively lock cover 14 in place relative to bowl 12. When so positioned, downwardly depending section 88 extends down over outermost edge 44 of platform 40 below bottom surface 48 of platform 40 such that protruding tab 102 extends just under bottom surface 48 of platform 40. In this manner, top surface 104 of protruding tab 102 interacts with bottom surface 48 to latch or selectively lock latch hook 84 to a corresponding latch saddle 36, thereby, selectively coupling cover 14 to bowl 12 and enclosing cavity 33. In one example, interior rim 80 is positioned and sized to abut sidewall 32 immediately adjacent top edge 34 around a substantial entirety of top edge 34. Interaction between interior rim 80 and sidewall 32 functions to align cover 14 with bowl and to further hold cover 14 in place over bowl 12. Interaction of protruding tab 102 with latch saddle 36 generally holds perimeter flange 72 of cover 14 more tightly against top edge 34 of bowl 12 providing for more protection of any food inside bowl 12 and/or decreases the likelihood that any of food inside bowl 12 will leak out between cover 14 and bowl 12 during transport.

Figure 11:
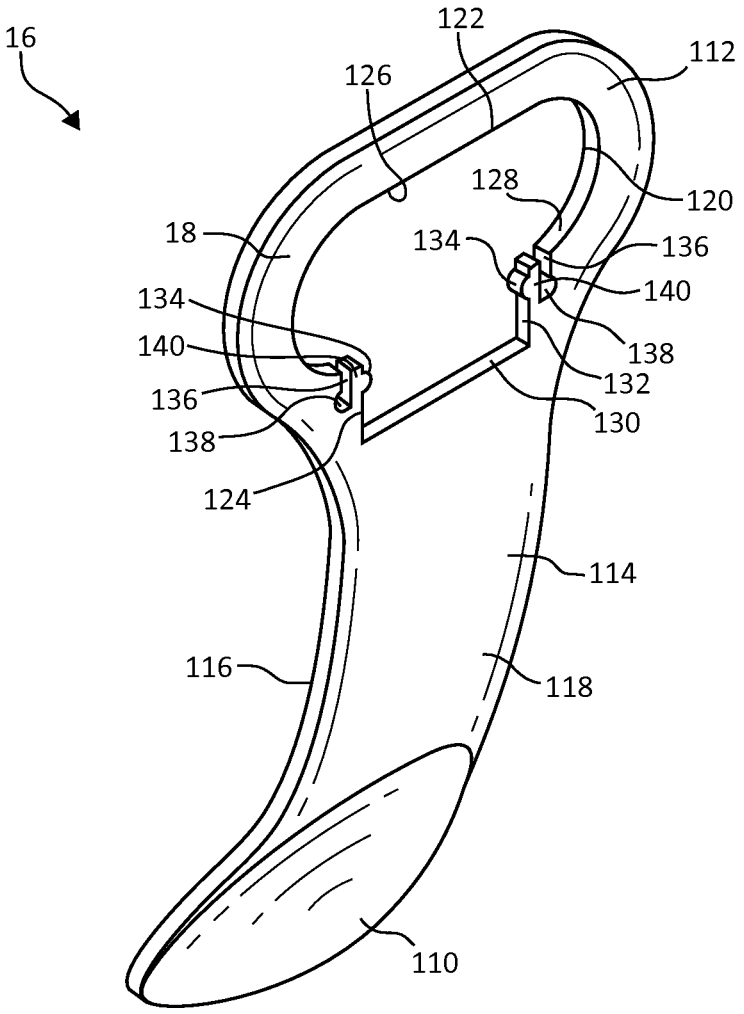
FIG. 11 is a cross-sectional view illustration of a utensil of the food storage and serving assembly of FIG. 1, according to one embodiment of the present invention.

FIG. 11 illustrates one embodiment of one of utensils 16, more particularly, of spoon 18. Each utensil 16 includes a first end 110, a second end 112, and an intermediate section extending from first end 110 to second end 112. Utensil 16 includes an interior facing surface 116 and an exterior facing surface 118 opposite interior facing surface 116. In one embodiment, each utensil 16 is formed with a curvature from first end 110 to second end 112 corresponding with a slope or curvature of sidewall 32 such that when food storage and serving assembly 10 is constructed, utensil 16 follows near sidewall 32 with a similar curvature. In one example, each of spoon 18 and fork 20 (FIGS. 1-7) are substantially identical other than the details of first end 110. First end 110 is configured for interaction with food, such as in mixing and/or serving a salad. First end 110 of spoon 18 includes a cupped or domed structure for scooping and stirring, while first end 110 of fork 20 includes a pronged end for stabbing, lifting, and stirring food. Utensils 16 each define one example of means for tossing and serving food items within bowl 12.

Second end 112 is, in one example, a widest part of utensil 16 and includes a handle opening 120 allowing utensil 16 to function as a handle for transporting food storage and serving assembly 10. In one embodiment, handle opening 120 includes a primary section 122 and a depending section 124. Primary section 122 of handle opening 120 is rectangular or ovular in one embodiment with the largest dimension thereof extending transverse to the extension of utensil 16 between first end 110 and second end 112, according to one example. More specifically, primary section 122 includes a top edge 126 nearest second end 112 and an opposite bottom edge 128. A distance between top edge 126 and second end 112 is preferably large enough to avoid breakage of utensil 16 while being small enough to allow a user to easily slip her fingers through handle opening 120 and around the portion of utensil 16 between top edge 126 and second end 112 to manipulate food storage and serving assembly 10.

Depending section 124 of handle opening 120 is narrower than primary section 122 and extends downwardly from bottom edge 128 of primary section to a bottom edge 130. As such, depending section 124 defines opposing side edges 132 thereof. Each side edge 132 defines a protruding pin or bump 134 near a top thereof and extending toward the other one of opposing side edges 132. A cut or slot 136 extends from primary section 122 of handle opening 120 downwardly and substantially parallel to a corresponding one of side edges 132 just outside of the corresponding one of side edges 132. In one example, slot 136 terminates opposite primary section 122 of handle opening 120 with a bulbous end 138. In this manner, material between side edges 132 of depending section 124 and slot 136 defines a locking arm or clasping arm 140 biased to its standard position, but able to flex outwardly away from depending section 124 when appropriate forces are applied thereto.

Figure 12:
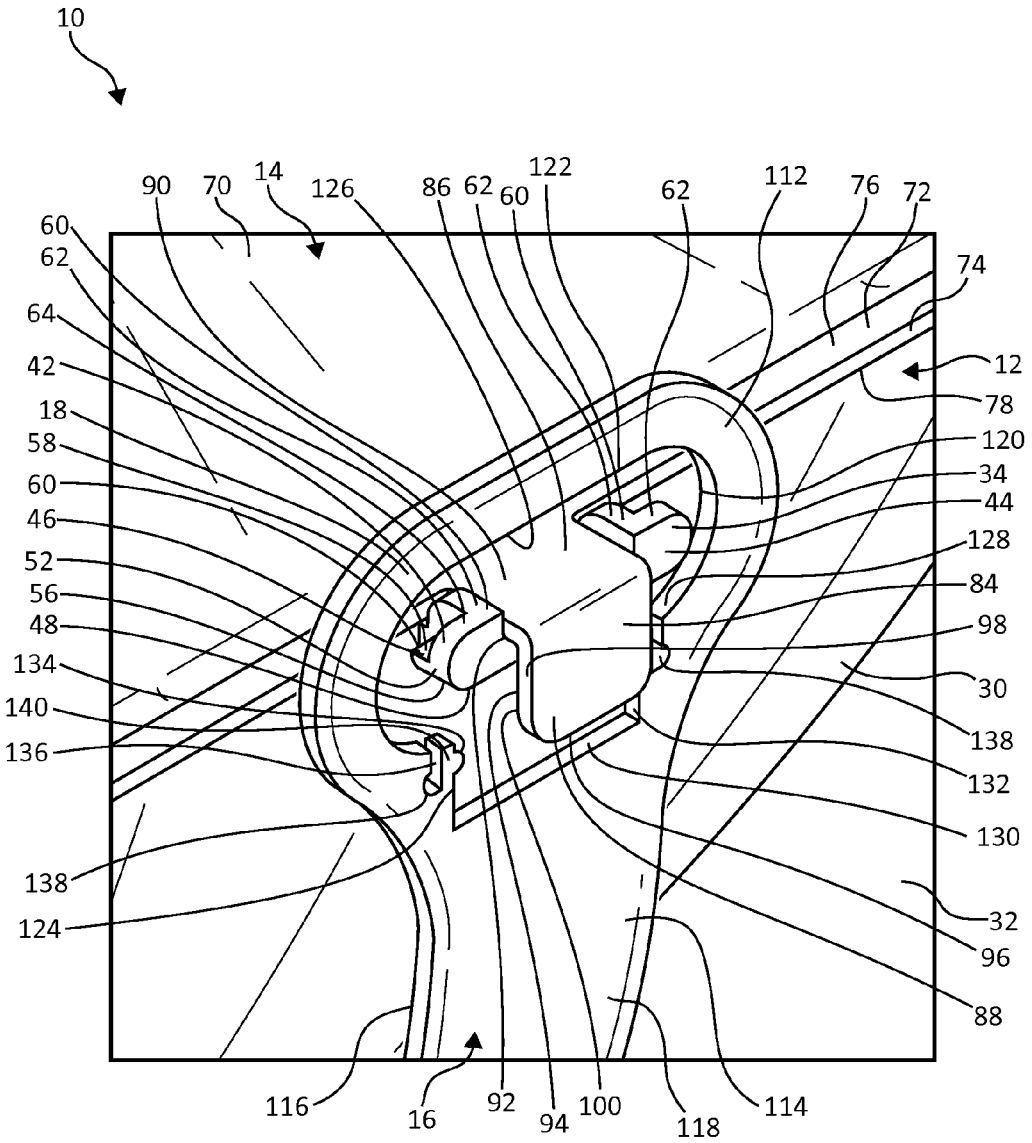
FIG. 12 is a partial, enlarged, and partially assembled perspective view illustration of a latch and a utensil of the food storage and serving assembly of FIG. 1, according to one embodiment of the present invention.
Figure 13:
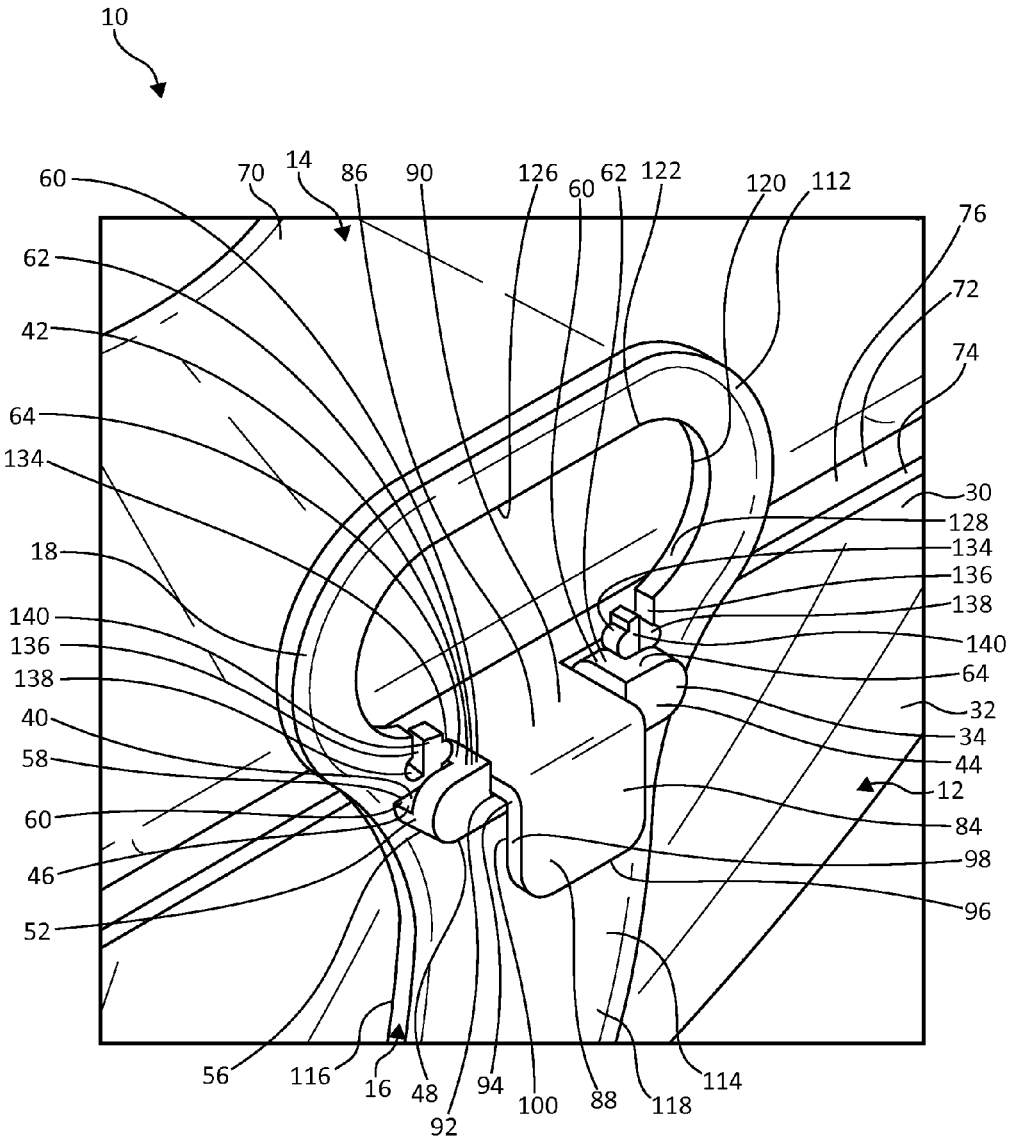
FIG. 13 is an enlarged, partial perspective view illustration of a latch and a utensil of the food storage and serving assembly of FIG. 1, according to one embodiment of the present invention.

As shown in FIGS. 1-7, during use, each utensil 16 is secured to latch saddle 36 about latch hook 84. More particularly, each utensil 16 is placed such that corresponding ones of latch saddle 36 and latch hook 84 extend through primary section 122 of handle opening 16 in a manner laterally aligning side edges 54 of latch saddle 36 with side edges 132 of depending section 124 of handle opening 120 as illustrated, for example, in the detailed view of FIG. 12. Utensil 16 is then pulled upwardly, for example, via user interaction with second end 112 thereof, such that protruding bumps 134 of utensil 16 interact with side edges 54 of latch saddle 36 causing clasping arm 140 to flex outwardly to move over side edges 54. Utensil 16 is further pulled upwardly until protruding bump 134 clears protruding rail 42, at which point clasping arm 140 flexes inwardly back toward its original or biased position moving protruding bump 134 to extend over and/or contact top surface 60 of protruding rail 42 as illustrated in FIG. 13. Since there is one clasping arm 140 with a protruding bump 134 on each of opposing sides of latch saddle 36, interaction between the two protruding bumps 134 with top surface 60 of protruding rail 42 selectively maintains utensil 16 hanging in place relative to bowl 12 from latch saddle 36.

In one example, protruding bump 134 is rounded, tapered, or otherwise shaped to induce outward flexing of clasping arm 140 about bulbous end 138 due to downward force applied to utensil 16. Flexing of clasping arm 140 allows protruding bump 134 to move outwardly to clear side edges 54 of latch saddle 36 as utensil 16 is uncoupled from bowl 12. The shape of protruding bump 134 and material properties of utensil 16 are configured to require a threshold force to outwardly flex clasping arms 140 and to allow decoupling of utensil 16 from bowl 12. The threshold force generally is higher than an inadvertent bump, but is low enough to be readily easily achieved by even an elderly or slight user pushing down on utensil 16 to uncouple the utensil from bowl 12. In this manner, utensil 16 generally remains coupled about latch saddle 36, while still allowing for ready decoupling of utensil 16 from bowl 12 when desired.

When cover 14 is coupled to bowl via latch saddles 36 and latch hooks 84 and both utensils 16 are coupled to bowl 12 via clasping arms 140 and latch saddles 36, a user is able to grasp each of the two second ends 112 or handle portions through the corresponding handle openings 120 to carry the resultant food storage and serving assembly 10. Upon arrival at a desired setting, the user presses down on each utensil 16, either substantially simultaneously or all at once causing protruding bumps 134 to release latch saddles 36 and utensils 16 to uncouple from bowl. Once utensils 16 are removed, the user pulls outwardly on downwardly depending sections 88 of latch hook 84 to move protruding tab 102 to pass by outermost edge 44 of platform 40 and uncouple cover 14 from bowl 12. Utensils 16 optionally may be used to toss a salad or other food dish inside bowl 12 and/or to serve the salad and/or other food dish inside bowl 12. In this manner, all items needed for serving the salad and/or other food dish is part of the single food storage and serving assembly 10 and the user need not separately pack serving utensils, a bowl cover, etc. Accordingly, the present invention provides an easy to use assembly with dual-purpose handles or utensils 16. More specifically, in one embodiment, utensils 16 extend above bowl 12 and cover 14 to function as handles when food and storage assembly is in the storage and transport configuration and function as tossing and/or serving utensils when removed from bowl 12.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A food storage and serving assembly comprising:

a bowl defining a cavity therein and including a latch saddle radially extending outwardly from a remainder of the bowl;

a cover extending over the bowl to enclose the cavity, the cover including a latch hook selectively secured within the latch saddle to maintain the cover over the bowl; and a utensil selectively coupled with the bowl and extending about the latch hook and the latch saddle, wherein the utensil is one of a fork and a spoon, and the utensil defines a handle portion extending above the bowl and the cover to facilitate user transport of the food storage and serving assembly at least partially via user interaction with the handle portion of the utensil.

2. A food storage and serving assembly comprising:

a bowl defining a cavity therein and including a latch saddle radially extending outwardly from a remainder of the bowl;

a cover extending over the bowl to enclose the cavity, the cover including a latch hook selectively secured within the latch saddle to maintain the cover over the bowl; and a utensil selectively coupled with the bowl and extending about the latch hook and the latch saddle, the utensil a handle portion extending above the bowl and the cover to facilitate user transport of the food storage and serving assembly at least partially via user interaction with the handle portion of the utensil;

wherein:

the latch saddle extends outwardly from a top edge of the bowl, and the utensil is coupled to the bowl via the latch saddle.

3. The food storage and serving assembly of claim 2, wherein:

the utensil includes a handle opening and at least one clasping arm immediately adjacent the handle opening, the handle opening is formed through the handle portion, the at least one clasping arm includes a protruding bump extending into the handle opening, and the protruding bump selectively interfaces with a top surface of the latch saddle to selectively secure the utensil to the bowl.

4. The food storage and serving assembly of claim 3, wherein the at least one clasping arm flexes when the utensil is pushed upwardly relative to the latch saddle to move the protruding bump along a side wall of the latch saddle and to the top surface of the latch saddle.

5. The food storage and serving assembly of claim 3, wherein:

the at least one clasping arm is one of two clasping arms positioned on opposite sides of the handle opening, and each of the two clasping arms is configured to selectively interface with a different top surface of the latch saddle to selectively secure the utensil to the bowl.

6. The food storage and serving assembly of claim 3, wherein:

the handle opening includes a primary section and a depending section, the depending section extends from a bottom of the primary section and has a smaller width than the primary section, and the at least one clasping arm defines a side edge of the depending section.

7. The food storage and serving assembly of claim 2, wherein:

the utensil includes a handle end and a food interaction end opposite the handle end, the handle end defines an opening, and the latch hook and the latch saddle each extend through the opening when the utensil is coupled with the bowl.

8. The food storage and serving assembly of claim 7, wherein:

the latch saddle defines a platform extending away from the remainder of the bowl to an outermost edge of the platform, the platform defines a top surface and a bottom surface opposite the top surface, the latch hook defines a radially extending section and a downwardly depending section, the radially extending section extends across the top surface of the platform, and the downwardly depending section extends outside the outermost edge of the platform of the latch saddle.

9. The food storage and serving assembly of claim 8, wherein:

the downwardly depending section includes a protruding tab extending toward the latch saddle, and the protruding tab interfaces with the bottom surface of the platform to selectively maintain the platform between the protruding tab and the radially extending section of the latch hook.

10. The food storage and serving assembly of claim 8, wherein:

each of the radially extending section and the downwardly depending section is substantially planar, and the radially extending section and the downwardly depending section extend substantially perpendicularly relative to each other.

11. The food storage and serving assembly of claim 8, wherein:

the utensil includes a handle opening and at least one clasping arm immediately adjacent the handle opening, the handle opening is formed through the handle portion, the at least one clasping arm includes a protruding bump extending into the handle opening, the protruding bump selectively interfaces with a top rail surface of the latch saddle to selectively secure the utensil to the bowl, and the top rail surface of the latch saddle is spaced from and positioned above the top surface of the platform.

12. The food storage and serving assembly of claim 11, wherein:

the latch saddle includes opposing rails each extending from and above a different one of opposing sides of the platform to define a channel between the opposing rails and the platform, one of the opposing rails defines the top rail surface, and the latch hook is at least partially maintained within the channel when the cover is coupled to the bowl.

13. A food storage and serving assembly comprising:

a bowl defining a cavity therein and including a latch saddle radially extending outwardly from a remainder of the bowl;

a cover extending over the bowl to enclose the cavity, the cover including a latch hook selectively secured within the latch saddle to maintain the cover over the bowl; and a utensil selectively coupled with the bowl and extending about the latch hook and the latch saddle, the utensil defining a handle portion extending above the bowl and the cover to facilitate user transport of the food storage and serving assembly at least partially via user interaction with the handle portion of the utensil;

wherein:

the utensil includes a handle end and a food interaction end, the handle end defines an opening, and the latch hook and the latch saddle each extend through the opening when the utensil is coupled with the bowl.

14. A food storage and serving assembly comprising:

a bowl defining a cavity therein and including a latch saddle radially extending outwardly from a remainder of the bowl;

a cover extending over the bowl to enclose the cavity, the cover including a latch hook selectively secured within the latch saddle to maintain the cover over the bowl; and a utensil selectively coupled with the bowl and extending about the latch hook and the latch saddle, the utensil defining a handle portion extending above the bowl and the cover to facilitate user transport of the food storage and serving assembly at least partially via user interaction with the handle portion of the utensil;

wherein:

the latch saddle is a first latch saddle, the latch hook is a first latch hook, the utensil is a first utensil, the bowl defines a second latch saddle extending outwardly from the remainder of the bowl opposite the first latch saddle, the cover defines a second latch hook opposite the first latch hook and selectively received within the second latch saddle, the food storage and serving assembly further includes a second utensil coupled with the bowl via the second latch saddle, and the food storage and serving assembly is configured to be transported via user interaction solely with the first utensil and the second utensil.

15. A food storage and serving assembly comprising:

a bowl defining a cavity therein;

a cover extending over the bowl to enclose the cavity, wherein one of the bowl and the cover includes a latch saddle radially extending outwardly from a remainder of the one of the bowl and the cover, the other of the bowl and the cover includes a latch hook selectively secured within the latch saddle to maintain the cover over the bowl; and a utensil selectively coupled with the bowl and extending about the latch hook and the latch saddle, the utensil defining a handle portion extending above the bowl and the cover to facilitate user transport of the food storage and serving assembly at least partially via user interaction with the handle portion of the utensil;

wherein:

the utensil includes a handle end and a food interaction end opposite the handle end, the handle end defines an opening, the latch hook and the latch saddle each extend through the opening, and the utensil selectively clasps opposing edges of the latch saddle to couple the utensil to the latch saddle.

16. The food storage and serving assembly of claim 15, wherein:

the bowl defines the latch saddle such that the latch saddle radially extends outwardly from a remainder of the bowl, and the cover defines the latch hook.

* * * * *